US005265727A

United States Patent [19]

Anderson

[11] Patent Number: 5,265,727

[45] Date of Patent: Nov. 30, 1993

[54] GIFT WRAP CARICATURE

[76] Inventor: Donna D. Anderson, P.O. Box 1925, Sun Valley, Id. 83353

[21] Appl. No.: 908,158

[22] Filed: Jul. 2, 1992

[51] Int. Cl.[5] ..... B65D 75/00; B65D 75/54; B65B 21/06

[52] U.S. Cl. ..... 206/457; 53/442

[58] Field of Search ..... 206/45.33, 457, 458, 206/497; 229/87.19, 922, 923, DIG. 12, DIG. 3; 53/442, 557; D9/314, 311, 310, 317; D11/149, 150, 160, 161, 162

[56] References Cited

U.S. PATENT DOCUMENTS

| | | | |
|---|---|---|---|
| D. 150,636 | 8/1948 | Lanning | D11/160 |
| D. 178,931 | 10/1956 | Perkins | D9/317 |
| D. 313,572 | 1/1991 | Appenzeller | D11/160 |
| 1,685,393 | 9/1928 | Beadle | 206/497 |
| 3,035,689 | 5/1962 | Arnheiter | 206/47 |
| 3,099,568 | 7/1963 | Brody et al. | 206/45.33 X |
| 3,331,105 | 7/1967 | Gordon | 24/16 |
| 4,520,613 | 6/1985 | Claudio | 53/441 |
| 4,815,603 | 3/1989 | Harris | 206/45.33 X |
| 4,836,437 | 6/1989 | Kirschner | 229/923 |
| 4,873,814 | 10/1989 | Harris | 53/442 |
| 4,924,919 | 5/1990 | Oyler | 141/10 |
| 5,186,988 | 2/1993 | Dixon | 206/497 |

FOREIGN PATENT DOCUMENTS

| | | | |
|---|---|---|---|
| 1404832 | 5/1965 | France | 206/457 |

*Primary Examiner*—William I. Price

*Attorney, Agent, or Firm*—Frank J. Dykas; Craig M. Korfanta; Ken J. Pedersen

[57] ABSTRACT

A shrink wrap gift package is disclosed. A piece of shrink wrap film encloses a gift item. Excess shrink wrap film extending from the piece of film enclosing the gift is formed into body parts of humans, animals and plants. This way, the package creates a caricature of the human, animal or plant. A face decal may be placed on the outside surface of the package to emphasize the caricature. Also, a card for a message may be attached to the package.

7 Claims, 4 Drawing Sheets

GIFT WRAP CARICATURE

BACKGROUND OF THE INVENTION

1. Technical Field

This invention relates generally to gift packaging, and more particularly to shrink wrap gift packaging which creates caricatures of humans, animals and plants.

2. Background Art

Beadle, U.S. Pat. No. 1,685,393, discloses a method of wrapping fruit in a pre-formed bag of hydrated cellulose.

Arnheiter, U.S. Pat. No. 3,035,689, discloses a kit containing parts for forming animal figures.

Brody et al., U.S. Pat. No. 3,099,568, discloses a confection package made of a plastic or glassine bag formed to resemble a figurine toy.

Harris, U.S. Pat. No. 4,873,814, discloses a method for making a shrink wrap package which includes a dome-shaped cover for a basket and a plate-shaped cover for a box.

Still, there is a need in the gift wrap industry for an attractive shrink wrap package which creates caricatures of humans, animals and plants. Also, there is a need for a shrink wrap gift package wherein the shrink wrap material also creates body parts for the human, animal and plant caricatures. Also, there is a need for a shrink wrap gift package wherein a face decal may be placed on the outside of the package to emphasize the caricature.

DISCLOSURE OF INVENTION

I have invented a shrink wrap gift package which creates caricatures of humans, animals and plants. The package is a shrink wrap film which encloses a gift item. After enclosing the film around the item, I form body parts like hair, feet, fins or limbs, for example, from excess film and then shrink wrap the film by applying heat to it. The film shrinks to tightly wrap the item, and to form curled hair or wrinkled feet, fins, limbs or other body parts. Then, I may place a face decal on the outside of the wrapped item to emphasize the caricature. Also, I may attach a "bloop" card, for a written greeting or other message, to the wrapped gift package.

BEST MODE FOR CARRYING OUT INVENTION

Figure 1:
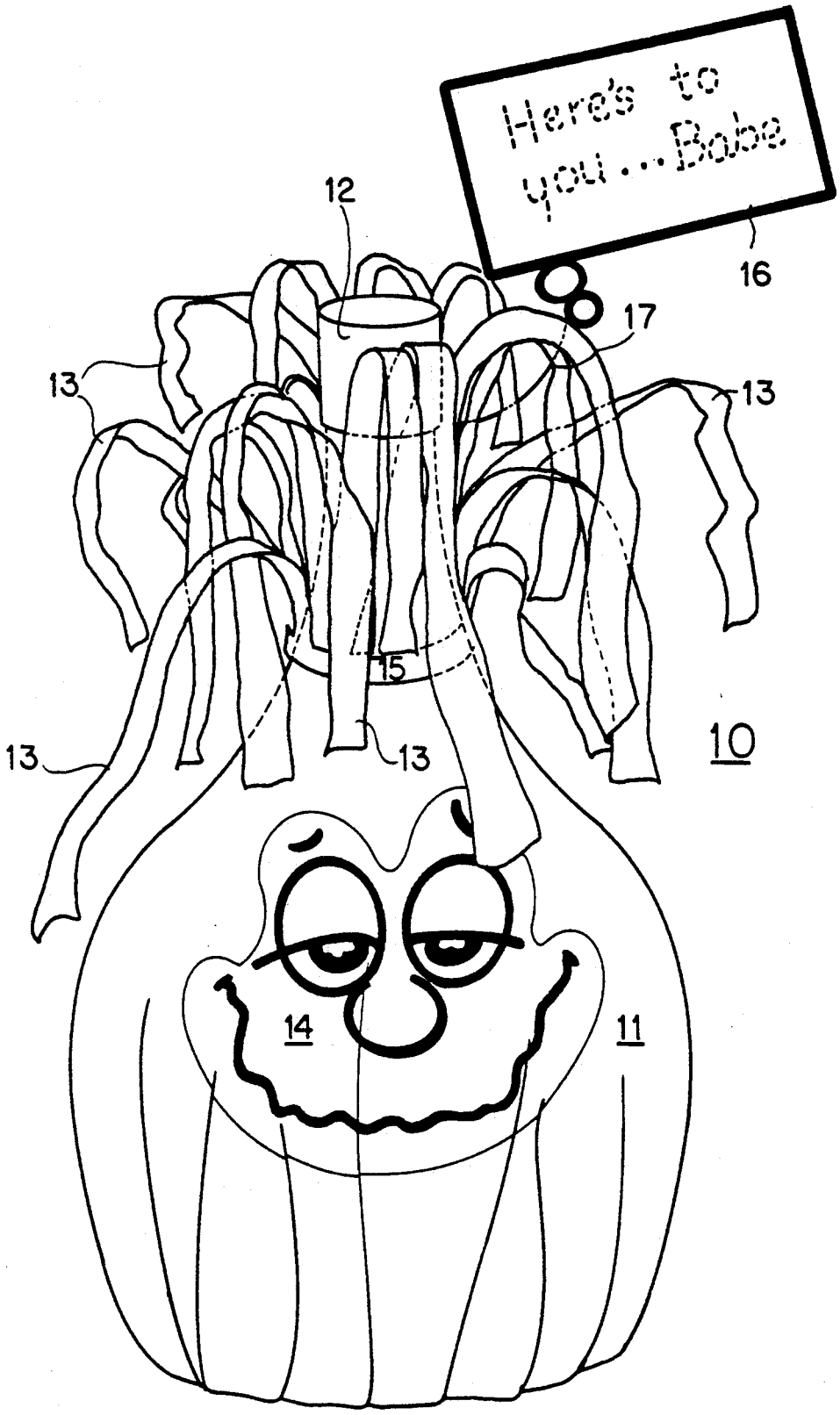
FIG. 1 is a perspective view of one embodiment of my invention.

Referring to the Figures, there is depicted generally several embodiments of my invention 10, 20, 30 and 40. In FIG. 1, a piece of shrink wrap material 11 encloses gift item 12, a small beverage bottle, for example, to make gift package 10. Excess shrink wrap material 13 extends from the piece of shrink wrap material 11 enclosing gift item 12. In this depicted embodiment, excess shrink wrap material 13 is formed into strands of curly hair to create the caricature of a human from the shape of the package.

Regarding the shrink wrap material 11, generally any thin, shrink wrap film will do. However, if the gift item 12 is fruit or other food, a film approved by the FDA for food packaging is required. Also, to be convenient, the film must be thin enough to respond to and shrink from the heat from a household hair dryer. I prefer a thin, less than 1 mil thickness, FDA-approved film available from VCF Co. in Michigan, USA (517) 546-2300.

By the terms "excess shrink wrap film material", I mean substantially more than enough of the film material to conveniently enclose the gift item 12. For example, in order to conveniently enclose most gift items, a small surplus of film material, generally in the range of 10–33% of the surface area of the gift item, is required. This small surplus provides enough film material for a convenient overlap of film material which facilitates securing the piece of film material around the gift item by fastening means 15, for example. Also, this surplus is usually enough to accommodate any irregularity in the shape or texture of the gift item, and still provide enough film for convenient overlap.

In my invention, on the other hand, the excess film material is generally in the range of 50–1,000% of the surface area of the gift item. For larger sized gift items, the excess % may be in the lower end of the range, and for smaller sized gifts, the excess % may be in the higher end of the range. This way, there is plenty of excess film material available for the person assembling the gift package to use the excess film to form the body parts for creating the caricature.

By the terms "extending from the piece of shrink wrap material", I mean the excess shrink wrap film material 13 is in contact with the piece of film material 11 used to enclose the gift item 12. Preferably, film material 11 and excess film material 13 are different portions of one piece of film material used to enclose the gift item 12. This way, part of the film piece is film material 11 for enclosing the gift item 12, and another part of the film piece is excess film material 13 for forming the body parts to create the caricature. Excess film material 13, however, may also be a separate, additional piece of film material in contact with and attached to the enclosing piece of film material 11.

Regarding the gift item 12, any reasonably small-sized gift will do. Some gift examples are pieces of fruit, beverage bottles, beverage cans and jewelry boxes. In my kit for making the gift package 10, I plan to provide a generally square piece of shrink wrap material of about 2 square feet. This way, most small gift items 12 may be easily enclosed by the piece of shrink wrap film, with plenty of excess film available to form the body parts to create the caricature.

Regarding the body parts, generally any body part may be formed with the excess film material. For example, hair, ears, feet, tails and tree limbs may be formed. The body parts may be modeled from parts of humans, animals and plants. Additional body parts also made from excess shrink wrap film material or from other materials, like paper, cardboard or fabric may also be attached to the package to further develop or emphasize the caricature.

A face decal 14 may be placed on the outside surface of the package to emphasize the caricature. In FIG. 1, the face decal depicts a human with a smug smile to create a gift package with an amusing personality. The face decal 14 may be attached to the package 10 in any convenient manner. I prefer a transparent, thin plastic film with an adhesive on its back side. The adhesive film may be printed with the likeness of a face to emphasize the caricature of the package. I have had best success with whimsical likenesses for my face decals.

Fastener 15 is an adjustable band, like a wire tie, for example, for securing the shrink wrap material 11 around the gift item 12. Fastener 15 is helpful for securing the shrink wrap material 11 before it is heated and shrunk to fit tightly around the gift item 12. Afterwards, fastener 15 provides a secure place for attaching card 16 by wire 17 to the package 10.

Card 16, preferably a "bloop" card to express thoughts, is attached to the package 10 by wire 17. This way, a greeting or other message may be conveniently written on card 16 and attached to the package 10.

Figure 2:
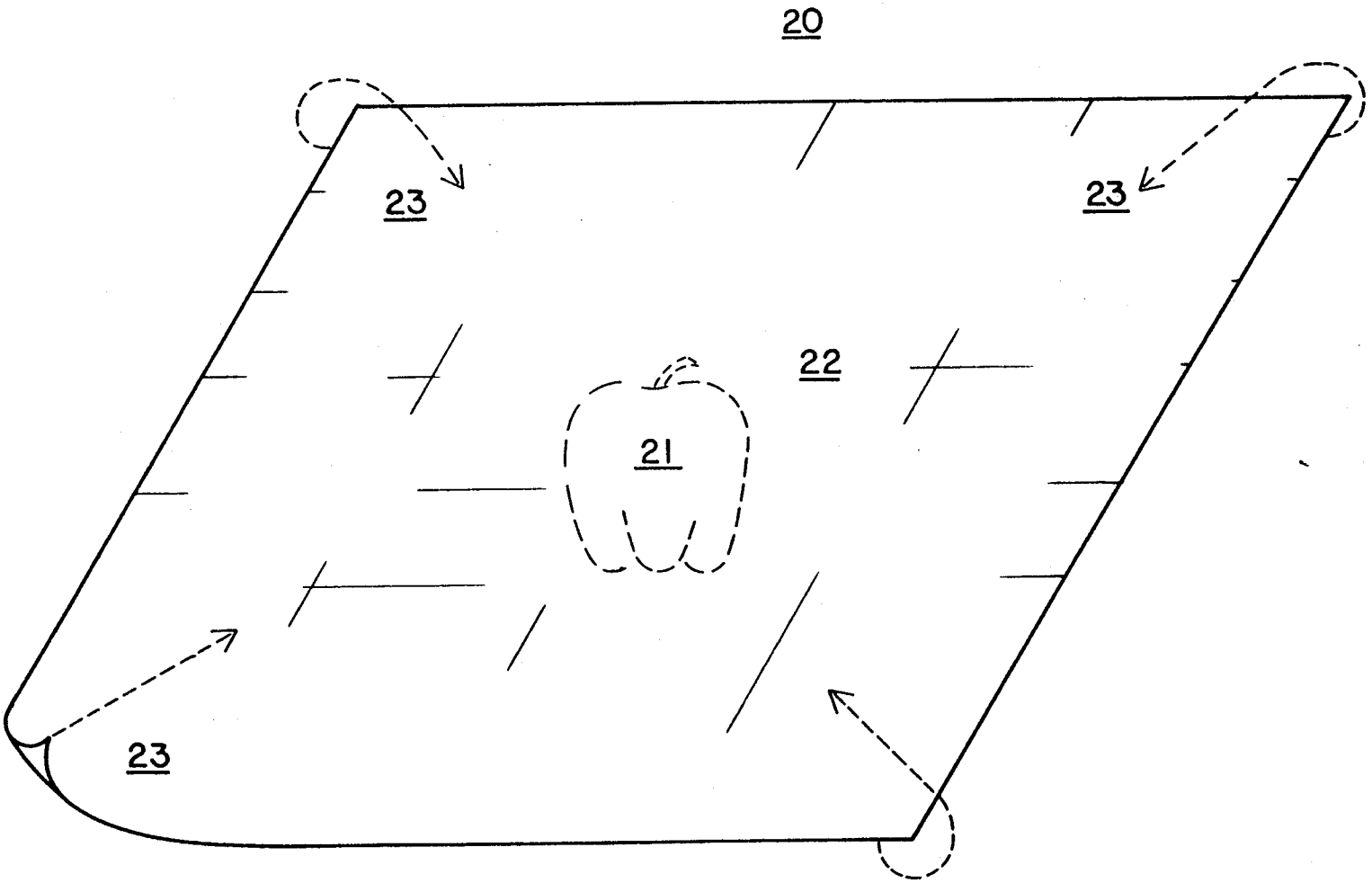
FIGS. 2 through 5 are perspective views of another embodiment of my invention during its assembly steps.

To make my invention, first place the gift item 21 in the center of the piece of shrink wrap film 22 for enclosing item 21 as depicted in FIG. 2. Note that in the embodiment depicted in this Fig. that the excess shrink wrap film material 23 is another part of the film piece which also contains the enclosing piece of film material 22.

Figure 4:
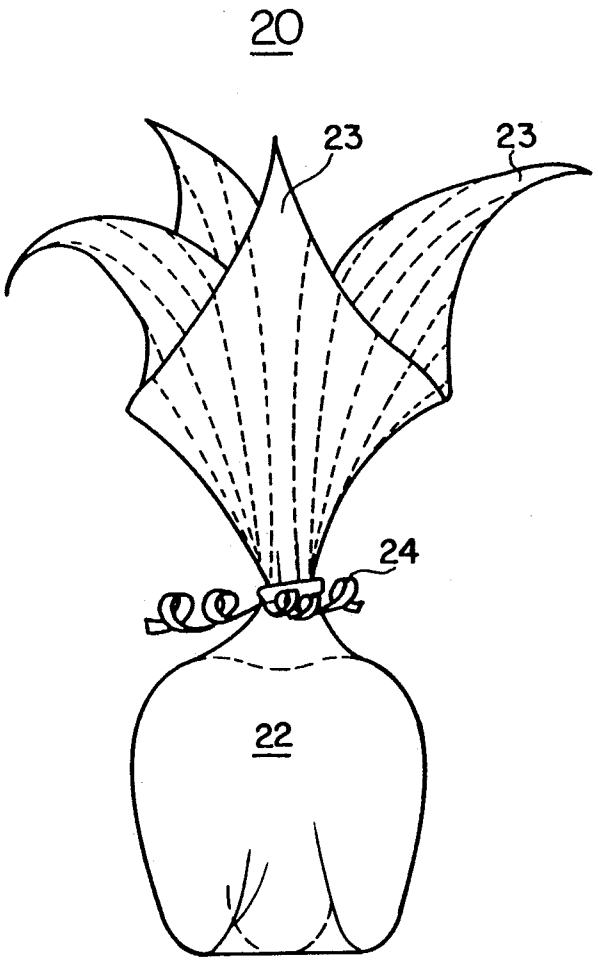
Figure 3:
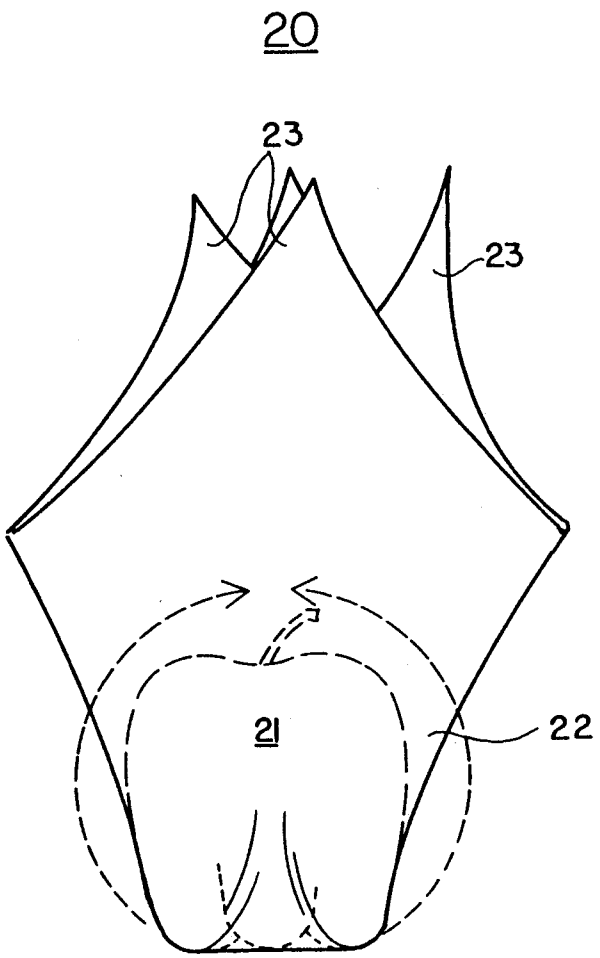

Then, lift up the corners of the film piece and enclose the item 21 as depicted in FIG. 3. Then, smooth the enclosing piece of film material 22 around the item 21 as much as possible and twist and tie the top of the film to hold it in place around item 21 as depicted in FIG. 4. Ribbon 24 may be used as a fastening means for securing the enclosing shrink wrap film material 22 around the gift item 21.

To make hair, cut about ¾" wide strips of excess film material 23 in from the edges towards the center as depicted in the dashed lines in FIG. 4. Be careful not to cut the strips all the way off.

Then, turn your hair dryer on hot/high, and hold it about 1–2" away from the wrapped package 20. Starting at the bottom of the package and gradually working your way to the top, use the dryer to heat shrink and tighten the enclosing piece of film material 22 around the item 21. Be careful not to overheat the gift item 21 if it is fragile. The shrink wrap film, however, is not likely to be overheated.

To heat treat and form the hair, first direct the heat from the dryer to the center of the cut strips where the film material has been tied with ribbon 24. Starting at the bottom of the excess film material there and gradually working your way up to the top, or ends of the cut strips, heat treat them with the dryer. Use your free hand to help form the shape of the hair as you work the dryer out from the center to the end of the strips.

Afterwards, a face decal and/or a card for a message may be attached to the package 20.

Figures 5, 6, 7:
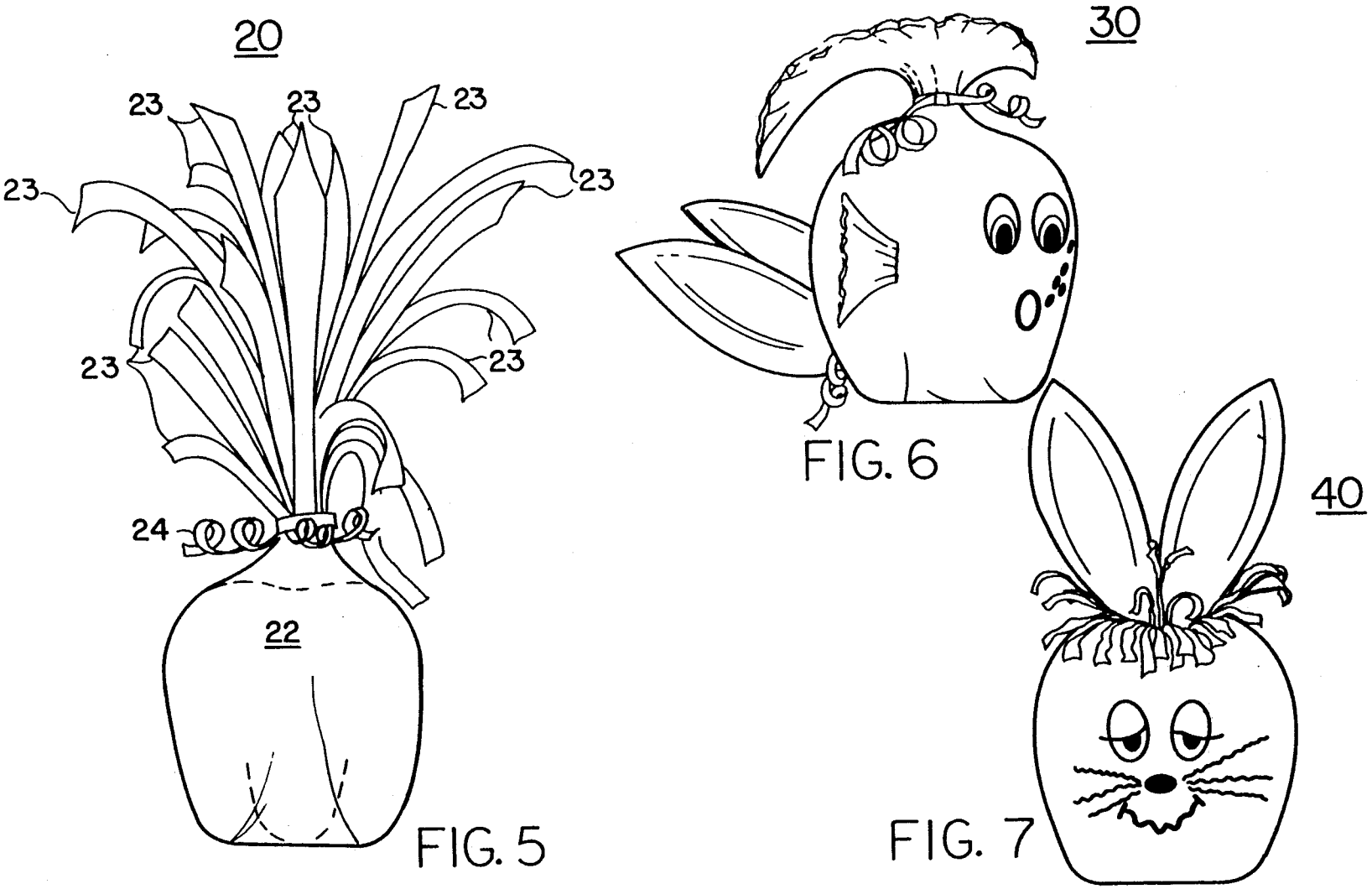
FIGS. 6 and 7 are perspective views of two other embodiments of my invention.

Alternate embodiments as depicted in FIGS. 6 and 7 may be made with my materials and technique. In FIG. 6, for example, the fish's hair, fins and tails may all be made from excess shrink wrap film material, or one or more of them may be made from another material. Likewise, the rabbit depicted in FIG. 7 may be made by the same technique. All that is required for my invention is that the gift item be enclosed by a piece of shrink wrap material, and a body part be formed of excess shrink wrap material to create a caricature of the gift package.

While there is shown and described the present preferred embodiment of the invention, it is to be distinctly understood that this invention is not limited thereto but may be variously embodied to practice within the scope of the following claims.

I claim:

1. A shrink wrap gift package comprising:

a piece of shrink wrap film material enclosing and heat-shrunk around a gift item to conform to the shape of the gift item, excess shrink wrap film material extending integrally from said piece of shrink wrap film material and out away from the gift item, said excess shrink wrap film material being cut and heat-shrunk for being formed into a body part for creating a caricature, and a face decal attached to the piece of shrink wrap film material that is heat-shrunk around the gift item for emphasizing the caricature.

2. The package of claim 1 which also comprises a car rigidly attached to and extending above the package for adding a message to the package as if spoken by the caricature.

3. The package of claim 1 wherein the excess shrink wrap film amounts to greater than 50% of the surface area of the gift item.

4. A shrink wrap gift package consisting of:

a piece of shrink wrap film material enclosing and heat-shrunk around a gift item to conform to the shape of the gift item, excess shrink wrap film material extending integrally from said piece of shrink wrap film material and out away from the gift item, said excess shrink wrap film material being cut and heat-shrunk into body parts for creating a caricature, a face decal attached to the piece of shrink wrap film material for emphasizing the caricature, a fastening means for securing the piece of shrink wrap film material around the gift item, and a card rigidly attached to the package for adding a message to the package as if spoken by the caricature.

5. The package of claim 4 wherein the excess shrink wrap film amounts to greater than 50% of the surface area of the gift item.

6. A method of making a gift package comprising:

wrapping a flat piece of shrink wrap film material around a gift item so that excess shrink wrap film material attached to the said piece of shrink wrap film material integrally extends from the said piece and out away from the gift item, heat-shrinking the piece of shrink wrap film material to conform to the shape of the gift item, cutting, hand-shaping, and heat-shrinking the excess shrink wrap film material to form body parts for creating a caricature, and attaching a face decal to the piece of shrink wrap film material that is heat-shrunk around the gift item for emphasizing the caricature.

7. The method of claim 6 wherein the excess shrink wrap film material amounts to greater than 50% of the surface area of the gift item.

* * * * *